United States Patent [19]

Castaldo

[11] 4,015,112

[45] Mar. 29, 1977

[54] METHOD OF MAKING ILLUMINATED HANDBAG

[76] Inventor: Stanley C. Castaldo, 704 N. Lake Pleasant Road, Apopka, Fla. 32703

[22] Filed: Dec. 5, 1974

[21] Appl. No.: 529,702

[52] U.S. Cl. ..... 240/6.45 P; 200/153 LB; 200/155 R

[51] Int. Cl.[2] ..... A45C 15/06

[58] Field of Search ..... 240/6.45 R, 6.45 P, 240/2 S; 200/336, 155 R, 273, 153 LA, 153 LB

[56] References Cited

UNITED STATES PATENTS

| | | | |
|---|---|---|---|
| 2,181,829 | 11/1939 | Jeffrey | 200/153 LA |
| 2,195,237 | 3/1940 | Bryant et al. | 200/336 |
| 3,609,341 | 9/1971 | Castaldo | 240/6.45 P |

*Primary Examiner*—L. T. Hix
*Assistant Examiner*—J. A. LaBarre
*Attorney, Agent, or Firm*—Duckworth, Hobby, Orman, Allen, & Pettis

[57] ABSTRACT

A method of making a handbag having an illuminatable interior includes steps of attaching an illumination source to the interior of the handbag, along with locating and attaching a latching clasp to the exterior wall of the handbag and a switch to the interior wall of the handbag directly across from the latching clasp on the exterior wall. The clasp and the switch are connected through the wall and a shaft extends from the clasp which will actuate the switch which is connected to the illumination source, thereby lighting the interior of the bag.

9 Claims, 6 Drawing Figures

METHOD OF MAKING ILLUMINATED HANDBAG

BACKGROUND OF THE INVENTION

The present invention relates to illuminated handbags and in particular to a method of making a lady's illuminated handbag.

It has been suggested in the past to provide ladies' handbags, pocketbooks or purses with an illuminating light so that when the handbag is opened the lady can see the contents in her handbag and can easily find a door or car key, or the like, therein. Handbags, pocketbooks and purses are referred to interchangeably herein to mean those containers normally carried by ladies for keeping miscellaneous items that may be needed by the lady, such as money, credit cards, house and car keys, makeup, and the like. One prior art lighted handbag has been suggested by the present inventor, U.S. Pat. No. 3,239,658 for LADIES' PURSE LIGHT WITH MAGNETIC SWITCH in which a magnetic switch is utilized to automatically turn the light inside the pocketbook on when the pocketbook is opened and off when it is closed. It has also been suggested in the past to provide a lighting mechanism for a handbag which can be easily removed from the handbag, and it has also been suggested to provide a pocketbook in which the fastening catch for closing the bag has been devised as a slide switch for switching an electric light on and off.

Finally, it has been suggested to provide a lady's handbag with a flashlight which broadly diffuses light for illuminating the inside of a lady's purse while having a removable portion for providing a narrow light beam such as may be needed to locate a keyhole. One of the most common types of handbags provided in today's market is closed by having a flap connected to, or forming part of one side of the handbag and which may be pulled across the other side of the handbag and latched with a clasp to close the bag. The clasp typically will have an elongated member attached perpendicular to a rotatably shaft connected to the outside of the handbag and the flap will have an elongated slot adapted to receive the clasp member which is then rotated to latch the bag closed.

U.S. Pat. No. 3,609,341 by the present inventor provides an illuminating handbag having a handbag using a flap and clasp type closing mechanism with an illuminating lamp inside in which a rotatable clasp may be used to switch the lamp on and off. The present invention is an improvement over this prior art patent in providing a simplified method of manufacturing an illuminated handbag of this type and adapting it to a great variety of different types of handbags during manufacture.

An illuminating handbag apparatus having a walk-along light is illustrated in my prior U.S. Pat. No. 3,800,134 which provides illumination for the interior of a handbag actuated by a magnetic switch in which the illuminating lamp can be shifted to the outside of the handbag.

SUMMARY OF THE INVENTION

The present invention relates to a method of making a handbag having an illuminatable interior and includes locating a switch on the interior wall of a handbag and locating a handbag latching clasp on the exterior wall of the handbag adjacent the switch but across the handbag wall from the switch and operatively attaching the latching clasp through the wall of the handbag to the switch so that opening or closing the handbag by operating the clasp will operate the switch. A lamp and power source are attached inside the handbag and are operatively connected to the switch so that the lamp is actuated by the opening or closing of the bag by the movement of the latching clasp. The handbag clasp has a rotatable handle with a shaft extending therethrough which is adapted to pass through the wall of the handbag to engage a keyway in the switch. Rotating of the shaft rotates a sleeve having camming contacts in the switch to actuate the switch. The shaft includes notched surfaces for attaching holding clips during assembly and for breaking off the shaft at predetermined points for use with different handbags.

BRIEF DESCRIPTION OF THE DRAWINGS

Other objects, features and advantages of this invention will be apparent from the written description and drawings in which.

DESCRIPTION OF THE PREFERRED EMBODIMENT

Figure 1:
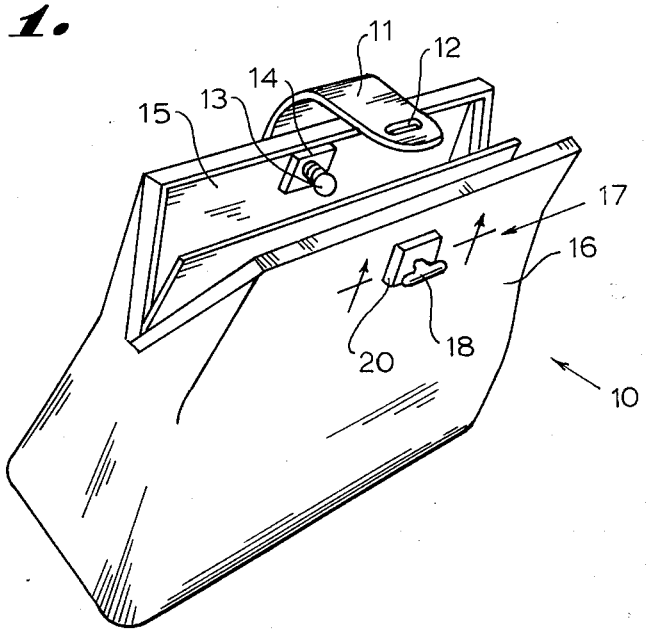
FIG. 1 is a perspective view of an assembled lighted handbag made in accordance with the present invention.

Referring now to FIG. 1, a perspective view of an illuminated handbag 10 is illustrated having a flap 11 with an elongated slot 12 therein and the handbag is open showing a lamp 13 attached to a socket base 14 attached to the interior wall 15 of the handbag 10. The exterior wall 16 of the handbag 10 has a clasp mechanism 17 with a rotating handle 18 attached to a base 20. The handle 18 is adapted to slide into the slot 12 of the flap 11 for closing and latching the handbag 10. Except for the lamp 13 the handbag is a conventional bag of the flap closing type.

Figure 2:
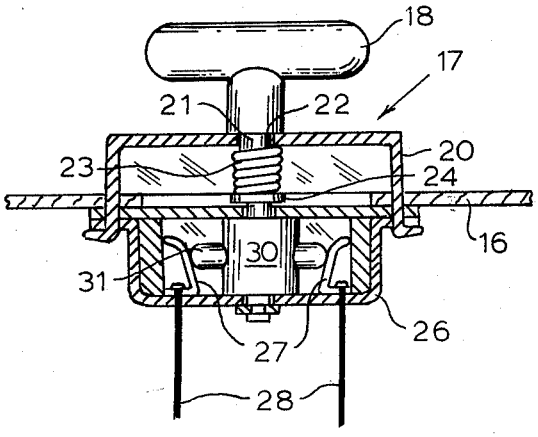
FIG. 2 is a sectional view taken along lines 2—2 of FIG. 1.
Figure 3:
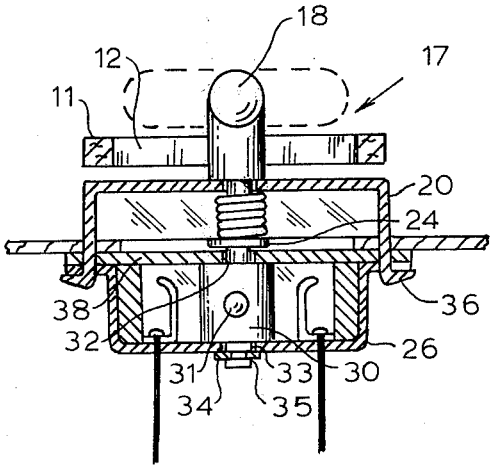
FIG. 3 is a sectional view in accordance with FIG. 2 with the clasp rotated 90°.
Figure 4:
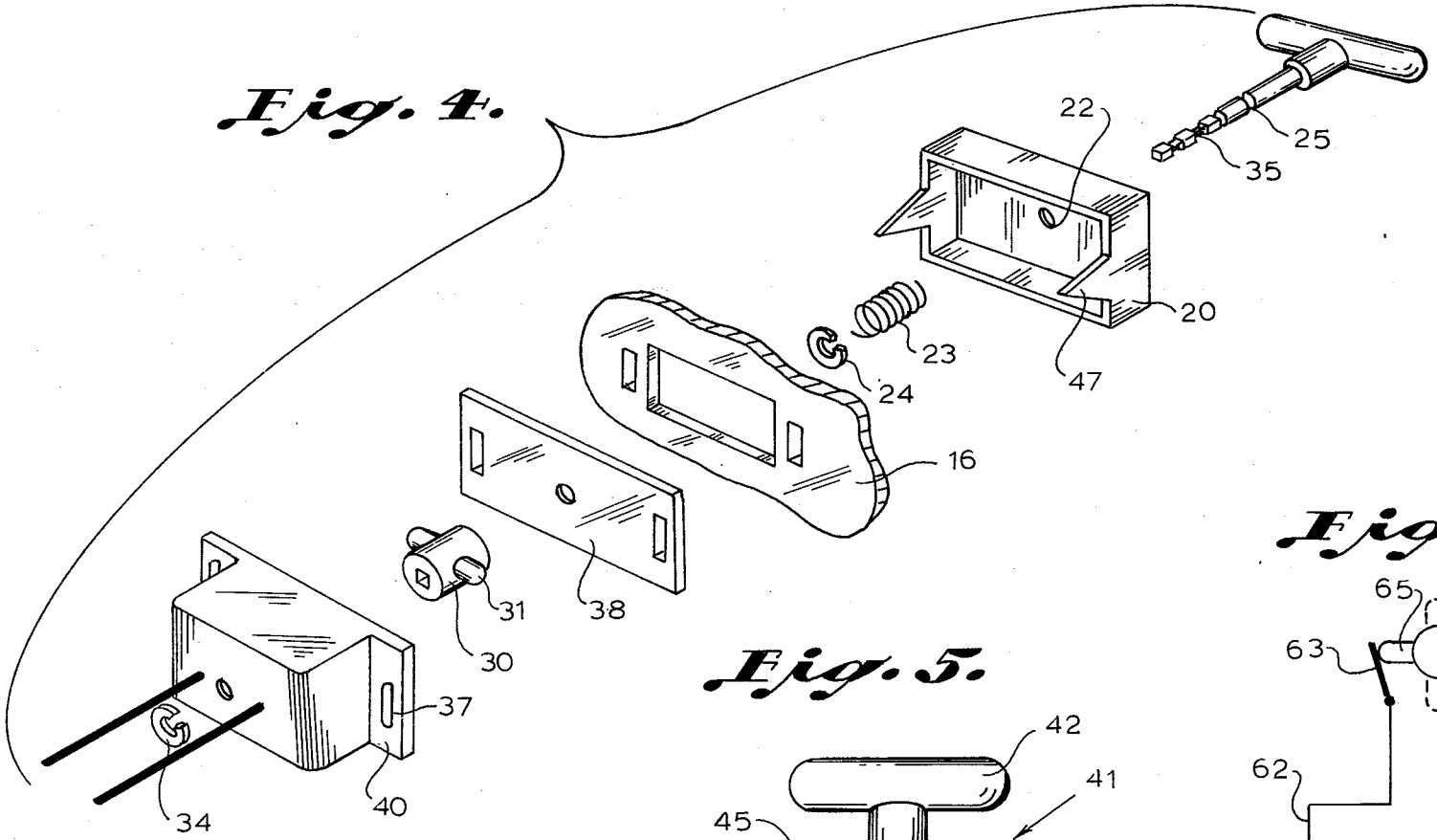
FIG. 4 is an exploded view of a clasp switch and a section of the pocketbook wall illustrating the method in accordance with the present invention.

FIGS. 2 through 4 more clearly illustrate the operation of the clasp and switch as well as the method of the present invention. The clasp 17 has the rotatable latching handle 18 passing through the latching clasp casing 20 with a shaft 21 passing through an opening 22 of the casing 17 and through a spring 23 which is held with a clip fastener 24 which snaps into a slot 25 of the shaft. The shaft 21 passes through the wall 16 of the pocketbook and through a switch 26 attached to the interior wall 16. The switch 16 has electrical contacts 27 thereinside connected to electrical conductors 28 which are in turn connected to the lamp 13 illustrated in FIG. 1 and to a battery source not illustrated. A sleeve member 30 has a pair of camming electrical contacts 31 attached thereto which engage the contacts 27 when turned in the direct position allowing the flow of direct current from one conductor 28 to the other to thereby actuate the lamp 13 by providing a closed circuit in accordance with the circuit diagram of FIG. 6. The switch 26 has an opening 32 for the shaft 21 to pass through and the sleeve 30 has a passageway therethrough for the shaft 21 to pass through and may be keyed or have a square or rectangular cross-section so that the shaft 21 will engage the sleeve 30 in a manner to rotate together. The shaft 21 passes out an opening 33 in the bottom of the switch casing 26 and is held with a clip attachment 34 in a slot 35. Shaft 21 can be made one length to fit different pocketbooks and can be broken off at one of the notches 35 if it is too long for a particular pocketbook. Notches 35 also act as a means for a clip 34 to engage to hold the shaft 21 and handle 18 firmly into the switch 26. A clasp latching mechanism 20 has a pair of pointed protrusions 36 which also pass through the pocketbook wall 16 and through a pair of openings 37 in the switch casing 26 and may be folded for latching the latching casing 20 to the switch casing 26 to hold both in position to the pocketbook. Switch casing 26 may also have a base member 38 which presses against the wall 16 during the assembly.

To assemble the present invention requires the attaching of a lamp 13 in lamp socket 14 to the inside of the pocketbook in a conventional manner such as with adhesives, or the like, and which may come preassembled with a battery case and wiring connecting the lamp battery case and the switch 26. The switch 26 is then positioned inside the pocketbook and the latching clasp 17 positioned on the outside of the pocketbook and the shaft 21 slipped through an opening in the wall 16 of the pocketbook, through an opening in the covering 38 of the switch 26, through the sleeve 30 and out the back of the casing of the switch where it is then latched thereto with the clip 34. As the shaft is pushed through, the pointed prongs 36 pass through the wall 16 of the pocketbook and through the openings 37 in the switch flanges 40 and are bent to further support the latching mechanism 17 and the switch 26 to each other and to the wall of the pocketbook. The switch would of course be preassembled as would the latching mechanism 17 which would be preassembled with the spring 23 held by the spring holding clip 24. This method provides switch 26 in a position inside the pocketbook safe from weather elements and reduces the bulk of the exterior clasp portion 17 while providing a rapid assembly for a great variety of pocketbooks. It should, however, be clear that variations are contemplated as being within the invention, such as using more than one lamp 13 without departing from the spirit and scope of the invention.

Figure 5:
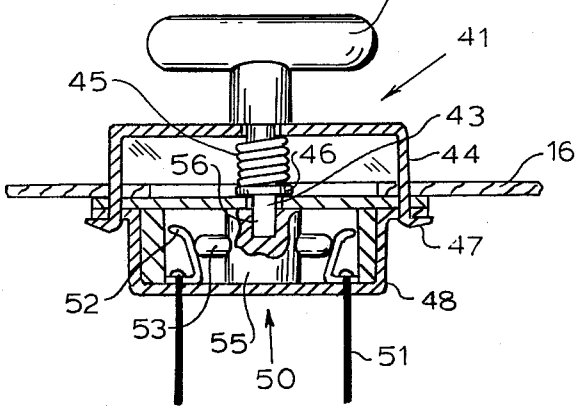
FIG. 5 is a sectional view of a second embodiment.

FIG. 5 illustrates a second embodiment having a latch clasp 41 having a rotable handle 42 having a shaft 43 extending therefrom through the casing 44 of the clasp 41. A spring 45 is attached with a spring clip 46 similar to the previous embodiment and is attached through the wall 16 of a pocketbook utilizing pointed prongs 47 which attach to a casing 48 of a switch 50 having electrical conductors 51 extending therefrom. The conductors are attached to contacts 52 actuated by electrical contacts 53 in a manner similar to the embodiment of FIGS. 1 through 4. This embodiment differs in that sleeve 55 does not extend through the casing 48 of the switch 50 but merely has a rectangular squared key portion 56 for accepting a matching protruding portion 43, switch 50 and the clasp 41 being held to the pocketbook by the bent prongs 47.

Figure 6:
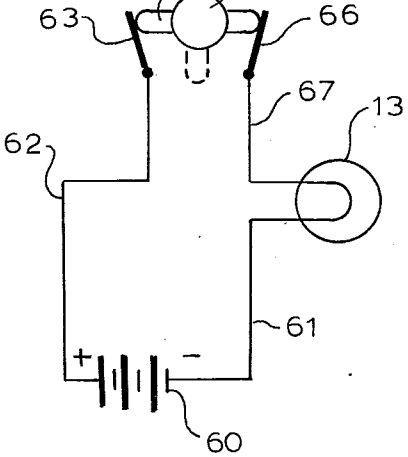
FIG. 6 is an electrical diagram of an electrical circuit which may be used in the pocketbook.

FIG. 6 illustrates the electrical diagram in accordance with the present invention having the lamp 13 connected to a battery source 60 through a conductor 61 and from the battery source 60 to a conductor 62 to one side of a switch contact 63. The rotating sleeve switch 64 has a pair of electrical contacts 65, one of which contacts the electrical contact 63 while the other contacts, electrical contact 66, connected by means of electrical conductor 67 to the other side of the bulb 13 to provide a closed circuit when the rotatable sleeve 64 is rotated to bring camming contact 65 in contact with electrical contacts 63 and 66.

It should be clear at this point that a method of making a lighted handbag which is switched on and off by the opening and closing of the bag by the latching and unlatching of the flap closing mechanism has been provided. It should, however, be clear that other latching mechanisms can utilize the invention without departing from the scope and spirit thereof. Accordingly, this invention is not to be construed as limited to the particular forms disclosed herein since these are to be regarded as illustrative rather than restrictive.

I clam:

1. A method of making an illuminatable handbag comprising the steps of:

a. positioning a switch on an interior wall of a handbag;

b. positioning a latching clasp on an exterior wall of said handbag across said handbag wall from said switch;

c. operatively attaching said positioned clasp through said wall to said positioned switch whereby said switch is actuated by operation of said latching mechanism including inserting a protruding shaft from said latching clasp into a sleeve in said switch to operatively connect said latching clasp and said switch;

d. attaching an illumination source operatively connected to said switch to the interior of said handbag and including attaching a battery power source to said handbag operatively connected to said illumination source and to said switch to operate said illumination source when a circuit is completed through said switch whereby said illumination source will be actuated by said switch when said latching clasp is actuated; and e. said latching clasp having a plurality of pointed protrusions which are pushed through said handbag wall and through flanges on said switch and then bent over said flanges to lock the latching clasp and switch together to the wall of said handbag.

2. The method in accordance with claim 1 in which the positioning and attaching of said latching clasp includes attaching a rotatable latching clasp rotated to actuate said switch between open and close positions.

3. The method in accordance with claim 1 in which a notched shaft is passed through said switching sleeve and clipped to the opposite side of said sleeve with a spring clip.

4. The method in accordance with claim 3 including the step of removing any excess shaft extending through said switch at one of a plurality of notched positions.

5. A method in accordance with claim 4 including the step of attaching a clip to a grooved area in said shaft adjacent said switch to lock said shaft to said switch.

6. The method in accordance with claim 1 in which said latching clasp has a short shaft key which is inserted into a protruding switch yoke to operatively connect said latching clasp to said switch.

7. The method in accordance with claim 6 in which a spring is inserted over the shaft of said latching clasp and locked in place with a spring clip prior to inserting said shaft through the wall of said handbag into said switch.

8. The method in accordance with claim 6 in which the step of inserting a short shaft key into a protruding switch yoke is inserted into a yoke having a pair of camming elements thereon which actuate said switch when said clasp is rotated.

9. An illuminated handbag apparatus having:

a. a lady's handbag;

b. an illuminated source attached to the interior of said lady's handbag;

c. a switch attached to the interior of said lady's handbag and operatively connected to said illumination source for actuating said illumination source;

d. a latching clasp attached to the exterior wall of said handbag, through said wall and to said switch;

e. said latching clasp having an extended shaft extending through said handbag wall and to said switch for actuating said switch when said latching clasp is rotated; and f. attaching means attaching said latching clasp and said switch together and to opposite sides of the wall of said handbag.

* * * * *